US011571788B2

(12) United States Patent
Monjardin et al.

(10) Patent No.: US 11,571,788 B2
(45) Date of Patent: Feb. 7, 2023

(54) ADJUSTABLE SUCTION SCREWDRIVER

(71) Applicant: International Business Machines Corporation, Armonk, NY (US)

(72) Inventors: Michael Benosa Monjardin, Shenzhen (CN); Tao Song, Shenzhen (CN); XiYuan Yin, Guangzhou (CN); Jia Yu Zheng, Foshan (CN); Yunfei Wang, Shenzhen (CN)

(73) Assignee: International Business Machines Corporation, Armonk, NY (US)

( * ) Notice: Subject to any disclaimer, the term of this patent is extended or adjusted under 35 U.S.C. 154(b) by 308 days.

(21) Appl. No.: 17/095,092

(22) Filed: Nov. 11, 2020

(65) Prior Publication Data

US 2022/0143791 A1 May 12, 2022

(51) Int. Cl.

| | |
|---|---|
| ***B25B 23/08*** | (2006.01) |
| ***B25B 23/00*** | (2006.01) |
| ***B25B 11/00*** | (2006.01) |

(52) U.S. Cl.

CPC ..... *B25B 23/08* (2013.01); *B25B 11/007* (2013.01); *B25B 23/0035* (2013.01); *B25B 23/0071* (2013.01)

(58) Field of Classification Search

CPC . B25B 23/08; B25B 23/0035; B25B 23/0071; B25B 11/007; B23P 19/005; B23P 19/006

See application file for complete search history.

(56) References Cited

U.S. PATENT DOCUMENTS

| | | | |
|---|---|---|---|
| 3,393,721 | A | 7/1968 | De Forest |
| 3,583,451 | A | 6/1971 | Dixon |
| 4,017,756 | A | 4/1977 | Davidson |
| 4,329,095 | A | 5/1982 | Schmuck |
| 4,922,436 | A | 5/1990 | Dohm et al. |

(Continued)

FOREIGN PATENT DOCUMENTS

| | | | |
|---|---|---|---|
| CN | 201950612 | U | 8/2011 |
| CN | 202668435 | U | 1/2013 |

(Continued)

OTHER PUBLICATIONS

IBM, "Automatic Screwdriver With Vacuum Pick-Up," ip.com, An IP.com Prior Art Database Technical Disclosure, IP.com No. IPCOM000063065D, IP.com Electronic Publication Date: Feb. 18, 2005, 3 pages https://priorart.ip.com/IPCOM/000063065.

(Continued)

*Primary Examiner* — David B. Thomas

(74) *Attorney, Agent, or Firm* — Peter J. Edwards

(57) ABSTRACT

A driver device may comprise a housing and a hole located on the housing. The hole may comprise a sealing lip. The driver device may comprise a bit holder located within the housing, and a bit socket located on the bit holder. The bit socket may be aligned with the hole, such that inserting a bit into the bit socket also inserts the bit into the hole. The driver device may comprise a spring located within the bit socket. The spring may cause an inserted bit to partially exit the hole in the absence of an external force pushing the it against the spring. The driver device may comprise a vacuum component connected to the housing, and a vacuum chamber within the housing.

19 Claims, 5 Drawing Sheets

(56) References Cited

U.S. PATENT DOCUMENTS

| | | | | |
|---|---|---|---|---|
| 4,924,732 | A | 5/1990 | Hoskins et al. | |
| 5,484,026 | A | 1/1996 | Susaki et al. | |
| 6,418,818 | B1 * | 7/2002 | Tham | B25B 23/10 81/54 |
| 7,178,432 | B1 | 2/2007 | Han et al. | |
| 7,997,164 | B2 * | 8/2011 | Miyamoto | B23P 19/06 81/52 |
| 8,127,643 | B1 * | 3/2012 | Tan | B25B 23/10 81/57.37 |
| 8,245,601 | B1 | 8/2012 | Hastama et al. | |
| 8,327,529 | B1 * | 12/2012 | Tan | G11B 25/043 360/245.9 |
| 8,454,755 | B1 * | 6/2013 | Tan | G11B 17/228 29/603.03 |
| 9,737,979 | B1 | 8/2017 | Sungkhaphong et al. | |
| 2009/0090526 | A1 | 4/2009 | Zannini et al. | |
| 2009/0206122 | A1 | 8/2009 | King | |
| 2014/0265526 | A1 | 9/2014 | Knapp | |
| 2015/0190182 | A1 | 7/2015 | Sharifi-Mehr et al. | |
| 2017/0260771 | A1 | 9/2017 | Knudsen | |
| 2018/0333811 | A1 | 11/2018 | Maeda | |

FOREIGN PATENT DOCUMENTS

| | | | |
|---|---|---|---|
| CN | 203045288 | U | 7/2013 |
| CN | 103934673 | B | 8/2016 |
| DE | 10159336 | B4 | 8/2004 |
| JP | 2016507295 | A | 3/2016 |

OTHER PUBLICATIONS

Monjardin et al., "Guided Driver Device," U.S. Appl. No. 17/095,076, filed Nov. 11, 2020.

List of IBM Patents or Patent Applications Treated as Related, Dated Nov. 10, 2020, 2 pages.

* cited by examiner

ADJUSTABLE SUCTION SCREWDRIVER

BACKGROUND

The present disclosure relates to driver devices, and more specifically, to powered screwdrivers with suction mechanisms.

Driver devices such as powered screwdrivers, drills, impact drivers, and others (sometimes collectively referred to herein as "driver devices" or "screwdrivers") operate by engaging a bit (e.g., a screwdriver bit) with an object that is intended to be driven into another object (e.g., a screw, bolt). A motor within the driver device causes a bit to rotate. When the bit is properly seated within, for example, the head of a screw, rotation of the bit causes the screw to rotate.

SUMMARY

Some embodiments of the present disclosure can be illustrated as a driver device comprising a housing and a hole located on the housing. The hole comprises a sealing lip. The driver device also comprises a bit holder located within the housing, and a bit socket located on the bit holder. The bit socket is aligned with the hole, such that inserting a bit into the bit socket also inserts the bit into the hole. The driver device also comprises a spring located within the bit socket. The spring causes an inserted bit to partially exit the hole in the absence of external forces pushing the bit against the spring. The driver device also comprises a vacuum component connected to the housing and a vacuum chamber within the housing.

Some embodiments of the present disclosure can also be illustrated as a method of operating a driver device. The method comprises mating a screw with a bit of the driver device. The method further comprises pressing the screw towards a sealing lip on a housing of the driver device and seating the screw on the sealing lip. The method further comprises creating a partial vacuum within the housing. The method further comprises operating the driver device.

Some embodiments of the present disclosure can also be illustrated by a system comprising a processor and a memory in communication with the processor. The memory contains program instructions that, when executed by the processor, are configured to cause the processor to perform the above method of operating a driver device.

The above summary is not intended to describe each illustrated embodiment or every implementation of the present disclosure.

BRIEF DESCRIPTION OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figure 1A:
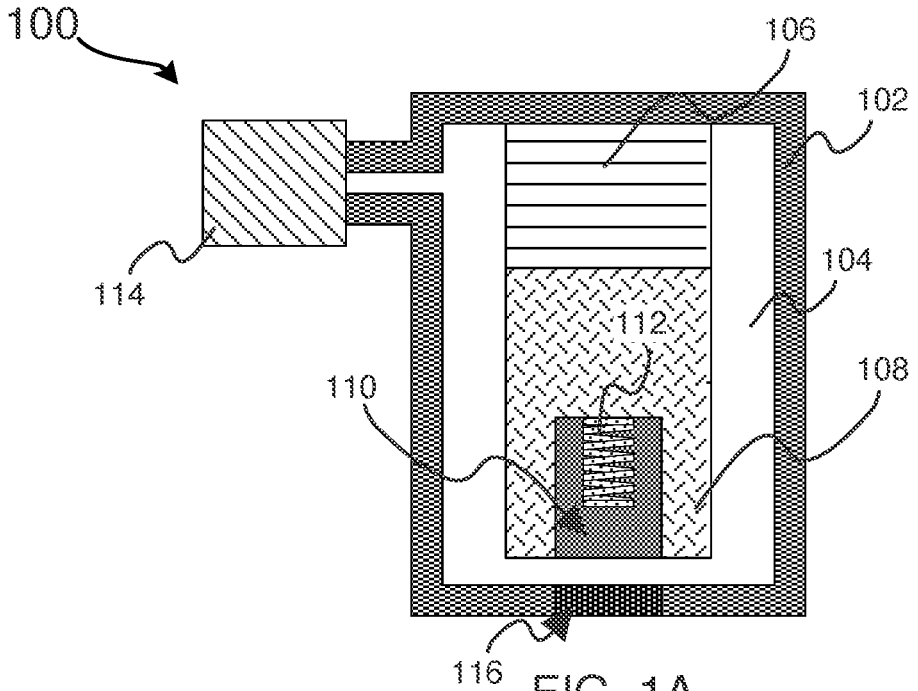
FIG. 1A depicts a first view of an adjustable driver device before insertion of a screwdriver bit.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

Aspects of the present disclosure relate to driver devices, and more specifically, to powered screwdrivers with suction mechanisms. While the present disclosure is not necessarily limited to such applications, various aspects of the disclosure may be appreciated through a discussion of various examples using this context.

Driver devices, such as screwdrivers, drills, impact drivers, and others are useful for driving structural fasteners, such as screws and bolts (sometimes collectively referred to herein as "screws"), into other objects. Typical powered driver devices can be used in a variety of circumstances, and thus are often constructed with the ability to accept driver bits of various shapes. For example, a common screwdriver design includes a bit socket of a hex (6-sided) shape that can accept screwdriver bits with a corresponding hex shape on one end. The other end of the screwdriver bit may be of a size and shape that corresponds to the type of screw with which it is interface to interface.

Some use cases of driver devices require screws to be inserted at precise angles. In these use cases, inserting a screw at an angle other than the desired angle may have negative results. For example, some products, such as high-end electronic personal devices, are manufactured with an aesthetic that requires exterior screws to be very flush with the surrounding exterior housing. A screw being inserted at an unintended angle may cause the screw to rest at that unintended angle once driven into the housing, resulting in part of the screw head jutting out past the surface of the exterior housing.

In some use cases, screws are inserted through several components (e.g., wooden boards). In these instances, the screw may operate both to keep the components from separating, but also from preventing the components from shifting with respect to each other. However, if a screw is inserted through such components at an unintended angle, the screw may exert an unintended torque on one or both of the components. This torque may cause the components to shift with respect to each other, and may even cause damage to one of the components or elsewhere.

Some use cases also involve a threaded screw being inserted into a hole with corresponding threads. If the screw is inserted at an angle that deviates from the desired angle, the screw threads or corresponding threads may be damaged. This may be particularly likely to occur in instances in which a screw is inserted with high torque (for example, when using a powerful drill or impact driver) or in which the threads on a screw or the corresponding threads are delicate (for example, due to small size or soft metal).

Further, some use cases involve driving screws into delicate components such as printed circuit boards. If a screw is inserted at an unintended angle, a higher force may be necessary to drive the screw than if the screw were inserted at the desired angle. In some instances this higher force may be translated to the PCB and connected components. This may result in damage to the PCB, connected components, or breaking of a connection between them.

For these reasons, typical screwdrivers have mechanisms in place to prevent screwdriver bits from being positioned at undesired angles during operation. For example, many bit sockets on driver devices feature a press-fit connection with inserted bits. In other words, the sockets are only barely large enough to contain the bit, thus preventing the bit from shifting in the socket. Some sockets also contain ball bearings that interface with a grove on a bit, keeping the bit in place.

However, it can be difficult to ensure that a screw stays parallel with a desired angle while the screw is being driven into another object. Sometimes this is because the drive bit used is not always a perfect match in terms of size or shape for the screw that is being driven. However, even when perfectly corresponding bits and screws are used, many screw heads and screwdriver bits are designed to allow for screw heads and screwdriver bits to interface at imperfect angles. This is partially to account for the fact that sometimes a driver device needs to be held at an awkward angle when driving a screw, such as when the working in tight spaces. However, this can also be to promote a screwdriver bit slipping out of the screw head when excess torque is applied. Both aspects of bit-screw design may be beneficial by enabling ease of use of a screwdriver and preventing a screw from being inserted too far or twisted too hard. However, the tolerance that results also can make it easier for a screw to sit on a screwdriver bit at an off angle, leading to detriments discussed above.

Some screwdrivers attempt to address these issues by magnetizing screwdriver bits, encouraging an attraction between screwdriver bits and screws. However, in most use cases the magnetic attraction between screw and bit may be sufficient to prevent a screw from completely falling off a bit, but is insufficient to prevent a screw from tilting while seated on a bit. Thus, some screwdrivers attempt to address these issues by incorporating vacuums in a screwdriver designs. These designs involve the head of a screw creating a seal on a housing of the driver device. A vacuum suction is then created within the housing, which causes the pressure (typically atmospheric pressure) outside the housing to push on the screw, keeping it in place. A bit then rotates the screw while the suction is applied, and thus the screw may be driven into another object while reducing the risk that the screw will tilt on the screwdriver bit.

While vacuum-based screwdriver designs can effectively prevent a screw from shifting on a screwdriver bit, they often cause additional problems. This is because vacuum-based screwdrivers are typically incapable of adjusting the position of the screw or screw bit, and thus are similarly incapable of adjusting to variations of the size, shape, and design of screw heads and screwdriver bits. While this may not be an issue for driver devices that always use screws and bits of the same size, shape, and design (for example, a computer-operated screwdriver in an assembly line that only screws one screw into one part), it can be a source of failure for vacuum-incorporating screwdrivers that are expected to work in more general applications. For these driver devices, variations between screw heads and driver bits may cause a bit and a screw head to not interface well. These variations may take several forms, and thus the potential number of permutations of fit between a screw head and driver bit can be quite large.

For example, the type of screw with which a bit is designed to interface may determine the shape of the screw bit, and the shape of a screwdriver bit may affect the fit of the bit in the screw head. Screwdriver bits that are designed to interface with screw heads featuring a small straight slot, for example, may feature a single small flat edge. These bits are often referred to as "flathead" bits. Bits that are intended to interface with screw heads with a large cruciform (i.e., cross shaped) hole may be larger and cruciform in shape. Bits also come in torx shapes, hex shapes, and others. Further, each shape category may have several sub categories, resulting in more variety in bit and screw shape. For example, cruciform screws and bits may come in a Phillips shape, a Frearson shape, and a Pozidriv shape.

The shape of a screwdriver bit not only affects the type of screw head it may interface with, but the depth to which the bit is intended to be inserted into the screw head. For example, a flathead screwdriver bit may properly interface with a screw head even if it is not inserted very far into the screw head, whereas a Phillips bit typically requires the bit to be inserted further into the screw head due to its pointed shape. Similarly, a torx bit with a flat head may not need to be inserted into a screw head as far as a torx bit with a slight taper to the head.

Further, screws may sometimes be driven with screwdriver bits that are not of an exactly corresponding size or design. For example a tapered torx bit may be used to drive a screw that has a tapered torx recess of a slightly larger size (for example, when driving a metric screw with an imperial bit), which can affect how far into the screw head the bit must be inserted in order to create an acceptable grip on the screw. As a further example, a Pozidriv bit may be used to drive a Phillips screw head, which may result in the bit being incapable of being completely inserted into the screw head.

The size and shape of a screw head can also affect the fit of a screwdriver bit within the screw head, and, relatedly, how far a driver bit would optimally be inserted into the screw head. To begin, the same analysis applied to screwdriver bits applies to screw heads. However, when using a vacuum screwdriver, the shape of the screw head also affects how far the screw head will be inserted into the housing before making a seal. For example, a flat-top screw head may be completely flush with the outer housing of a screwdriver when seated on a vacuum opening, requiring a bit to exit out of the housing in order to mate with the screw head. However, a screw head with a dome shape may protrude into the housing at the center in order to create a seal with the housing at the outer edges of the screw. This screw may therefore require the screwdriver bit to protrude out slightly less than the flat-top screw head.

Finally, manufacturing variances may also affect the fit of a screwdriver bit and screw head, and thus how far into a screw head a bit should be inserted. While most screws and bits follow industry standards, manufacturing imperfections can result in some bits being slightly longer than standard. Further, the recess of some screw heads may be slightly deeper than other recesses, even when standards attempt to maintain uniformity among screw heads. Finally, the shape of some screw heads or screwdriver bits may also deviate from standard shapes.

For the reasons discussed above, many factors may result in variations of the perfect fit between a screw head and screwdriver bit. Without an ability to adjust to these variations, a screwdriver bit and screw head may not interface well. Unfortunately, when a screwdriver bit is used to drive a screw with which it does not interface well, damage can result. For example, a screw head can be stripped during driving, making it difficult to completely drive the screw into place or remove it. This may be particularly problematic when the screw is completely stripped when only partially driven (e.g., when sticking halfway out of a board or device housing). These screws may be difficult to remove, potentially resulting in the object into which the screw was driven being wasted.

Further, using a screwdriver bit to drive a screw with which the bit does not interface well can damage the bit. This can be particularly likely in high-torque situations, such as when using a torx bit to drive a hardened screw with a powerful impact driver. Damaging a screwdriver bit can require it to be replaced. Repeated occurrence of damaged bits may result in increased costs and hassle, particularly for large projects or specialized, expensive bits.

Unfortunately, typical vacuum-fit screwdrivers do not allow for the position of the bit or the screw to be adjusted. For example, if the position of a screw is adjusted, the seal between the screw and the housing may be compromised, causing a loss of suction, which would defeat the purpose of the vacuum component. Further, typical screwdrivers prevent shifting of the screwdriver bit in order to prevent the bit from being dislodged. Thus, typical vacuum-fit screwdrivers may be more likely to damage screws and bits due to the inability to adjust to variations between screws and bits.

Some embodiments of the present disclosure address the above issues by featuring a driver device that is both capable of holding a screw in position using vacuum suction and capable of adjusting to variances in shapes of screw heads and screwdriver bits. In some embodiments, a bit holder in a screwdriver includes a spring that pushes an inserted bit towards the screw head. In some such embodiments the bit may be magnetized by the bit holder or by the spring in the bit holder.

In some embodiments, the bit holder may extend past the housing of the driver device when in a "resting" configuration. This may allow a screw to interface with the bit holder before being sealed to a vacuum chamber. In embodiments in which the bit is magnetized, a magnetic attraction between the bit and a screw may encourage proper seating of the screw on the bit. The screw may then be used to push the bit further into the bit holder as the screw is pushed onto a lip on the housing of the device. As the bit is pushed into the bit holder, the spring in the bit holder may be compressed, and may, as a result, push the bit holder into the screw head with greater force. This may continue to encourage a proper seating of the screw head and the bit, even when the screw and bit are being moved on the driver device.

When the screw head is pushed against the lip, a seal may be created between the inside of the housing (i.e., the vacuum chamber) and the outside of the housing. At this point a vacuum could be activated, creating a suction inside the device housing. This suction may hold the screw in place during operation of the driver device. However, because the screwdriver bit is being pushed into the screwhead by the compressed spring, the driver device may automatically adjust to variations of the size and shape of the screw head and of the screwdriver bit.

FIG. 1A depicts a first cross-sectional view of an adjustable driver device 100 before insertion of a screwdriver bit. As illustrated, driver device 100 is an abstraction of a driver device. The proportions, component patterns, and position of some components are designed for the sake of understanding, rather than for accuracy. As such, a version of driver device 100 that has been reduced to practice may differ in size, shape, layout, and components included, consistent with the embodiments of the present disclosure.

Driver device 100 features a device housing 102 that surrounds a vacuum chamber 104. A motor 106 and bit holder 108 are positioned within vacuum chamber 104. Motor 106 may, when activated, cause bit holder 108 to rotate in a pre-configured direction. Bit holder 108 includes a bit socket, the rear wall 110 of which is shown in FIG. 1. The bit socket may take a shape of a standard bit connector, such as a hexagon. Bit holder 108 also contains a spring 112, which is shown in a resting state. Bit holder 108, spring 112, or both, may be magnetized (for example, connected to an electromagnet or a permanent magnet).

Driver device 100 may also contain vacuum component 114. Vacuum component 114 may, in some embodiments, comprise a vacuum device (i.e., a device capable of creating a suction within vacuum chamber 104) or a vacuum connector that may be used to connect driver device 100 to a vacuum device. Finally, the device housing 102 of driver device 100 is illustrated with a hole, the rear wall 116 of which is shown in FIG. 1. The outer edges of this hole may be referred to herein as a "sealing lip." In some embodiments, pressing the head of a screw up against this sealing lip may create a vacuum seal between the device housing 102 and the screw, enabling a connected vacuum to create a vacuum (or near vacuum) in vacuum chamber 104. As illustrated, the hole in device housing 102 is approximately the same width of the bit socket in bit holder 108. In some embodiments, however, it may be larger than the bit socket.

In some embodiments, device driver 100 may be a standalone device, such as a powered impact driver with vacuum device attached. However, in some embodiments device driver 100 may actually be an add-on component, such as a component that could be inserted into the bit holder of an impact driver. In such embodiments, device driver 100 may not include a motor, because the motor of the impact driver into which device driver 100 is being inserted may be used to rotate bit holder 108.

Figure 1B:
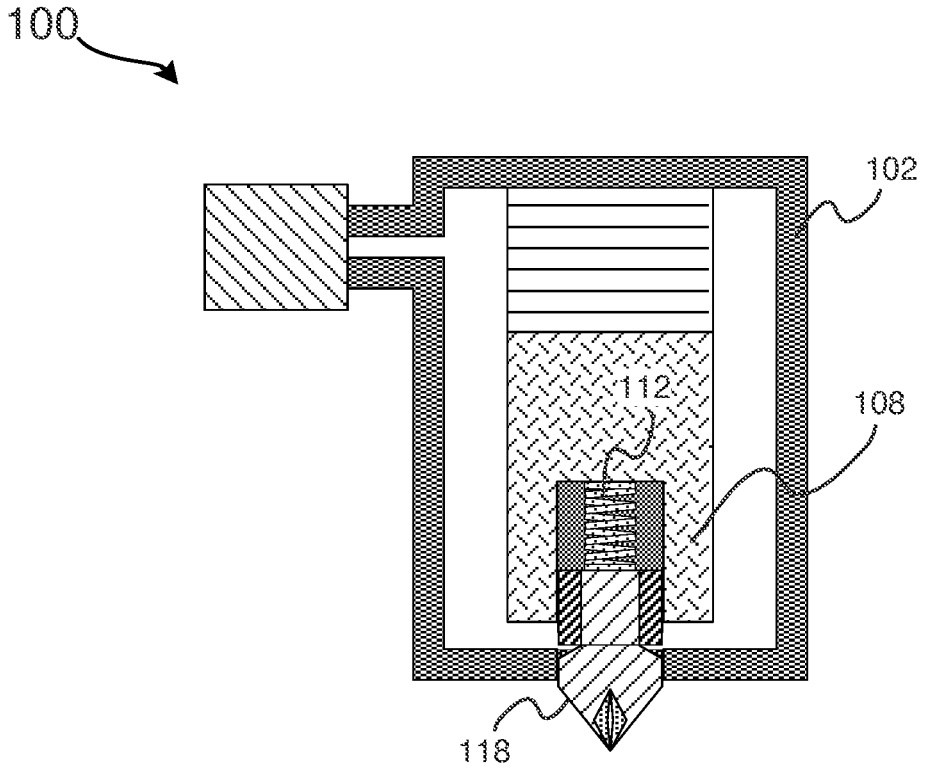
FIG. 1B depicts a second view of the adjustable driver device after insertion of a screwdriver bit.

FIG. 1B depicts a second view of adjustable driver device 100 after insertion of bit 118 into bit holder 108. As illustrated, bit 118 is being pushed by spring 112 into a position at which bit 118 could interface with a screw before that screw is pressed onto the sealing lip of device housing 102. In some embodiments, bit holder 108 or spring 112 may be designed to prevent bit 118 from being pushed completely out and falling out of device housing 102. For example, in some embodiments bit holder 108 may only be very slightly larger than bit 118, and thus an interference fit may form between bit 118 and bit holder 108. In other words, there may be sufficient friction between bit 118 and bit holder 108 that bit 118 is unlikely to fall out. Bit socket 118 or spring 112 may also be magnetically charged, and this magnetic charge may attract bit 118, preventing it from exiting bit holder 108. Bit 118 may also have a structural feature, such as an indent or groove, that a corresponding component of bit holder 108, such as a ball bearing, may interact with, resisting a tendency of bit 118 from exiting the bit socket.

Figure 1C:
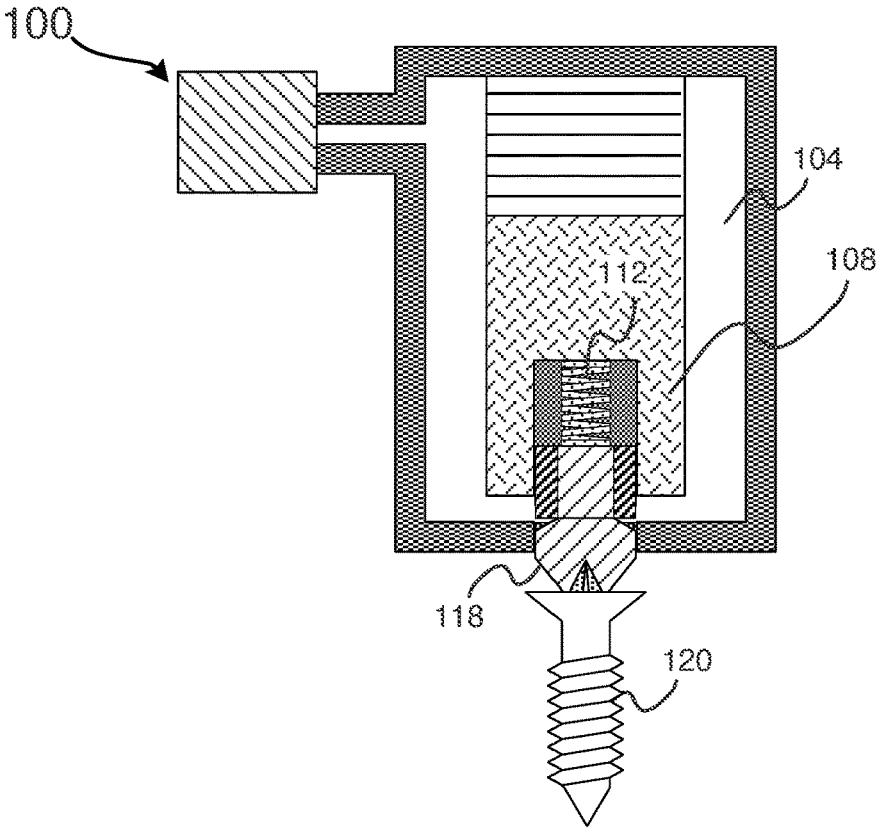
FIG. 1C depicts a third view of the adjustable driver device after a screw is mated with the screwdriver bit and prior to seating on a vacuum lip.

FIG. 1C depicts a third view of adjustable driver device 100 after a screw 120 is mated with bit 118 and prior to seating on the vacuum lip. In embodiments in which bit 118 is magnetically charged (for example, embodiments in which bit holder 108 or spring 112 have transferred a magnetic charge to bit 118, or embodiments in which bit 118 itself contains a permanent magnet), screw 120 may be attracted to bit 118, encouraging a proper interface between bit 118 and screw 120. In other embodiments, it may be necessary to hold screw 120 in place on bit 118 by an outside force until a suction within vacuum chamber 104 is able to hold screw on the sealing lip.

Figure 1D:
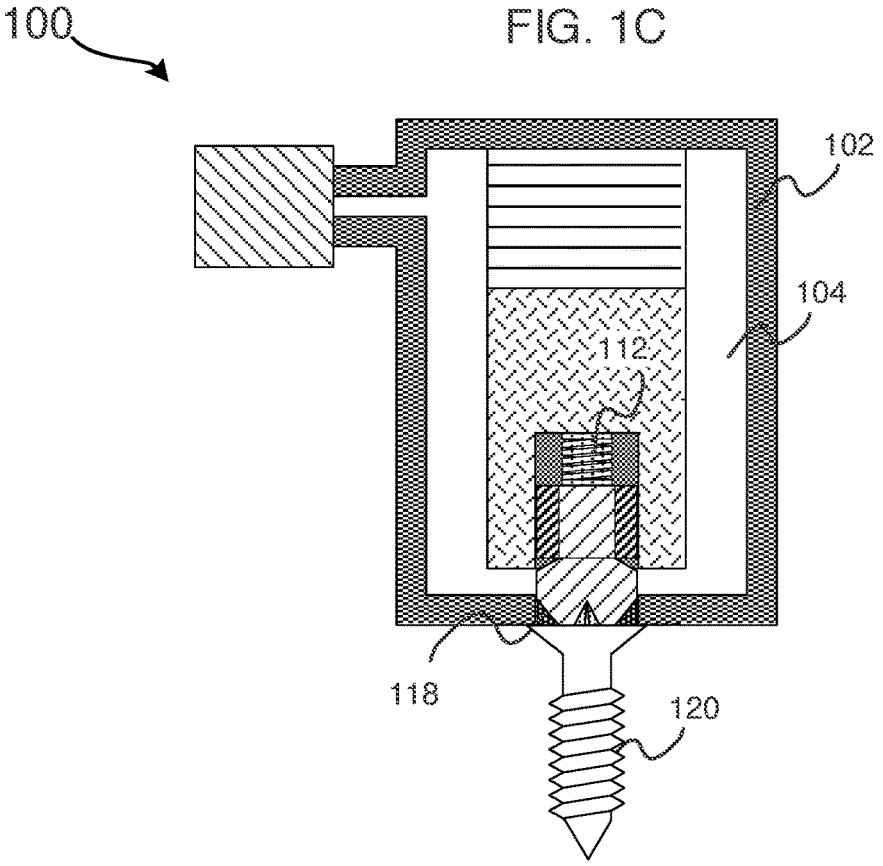
FIG. 1D depicts a fourth view of the adjustable driver device after the screw is seated on a sealing lip.

FIG. 1D depicts a fourth view of adjustable driver device 100 after screw 120 is seated on the sealing lip of device housing 102. The configuration of FIG. 1D may have resulted, for example, by a user or a robotic arm pushing screw 120 towards bit holder 108 after screw 120 had mated with bit 118. As illustrated, screw 120 has made contact with the sealing lip (i.e., the portion of device housing 102 that surrounds the opening out of which bit 118 protruded). Thus, at this point vacuum component 114 (or a vacuum device to which vacuum component is connected) could activate and create a vacuum (or near vacuum) within vacuum chamber 104. This vacuum may create a significantly high pressure gradient between the environment inside vacuum chamber 104 and the environment outside device housing 102. Due to this pressure gradient, screw 120 may be pushed onto the sealing lip by the surrounding air, keeping screw 120 in place, even during operation of driver device 100. However, because spring 112 has been compacted by screw 120 pushing bit 118 further into the bit socket, screw 120 would apply a force to bit 118, pushing it into screw 120. This force would encourage bit 118 to remain properly seated within a recess in the screw head of screw 120. Thus, even though the position of screw 120 may be dictated by the seating of screw 120 on the sealing lip, the position of bit 118 may be adjustable to the position of screw 120.

Figure 2A:
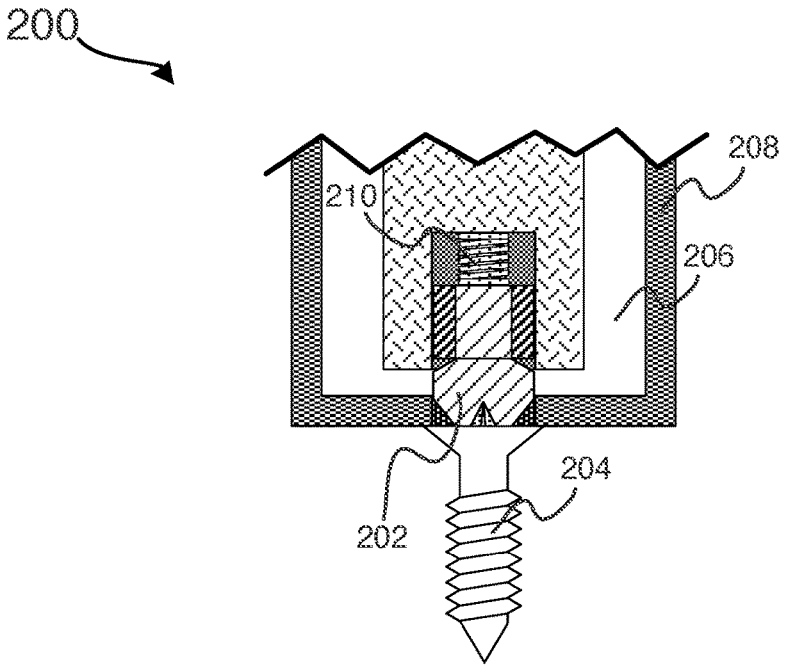
FIG. 2A depicts a view of an adjustable driver device configured to drive a screw with a flat screw head using a cruciform bit.
Figure 2B:
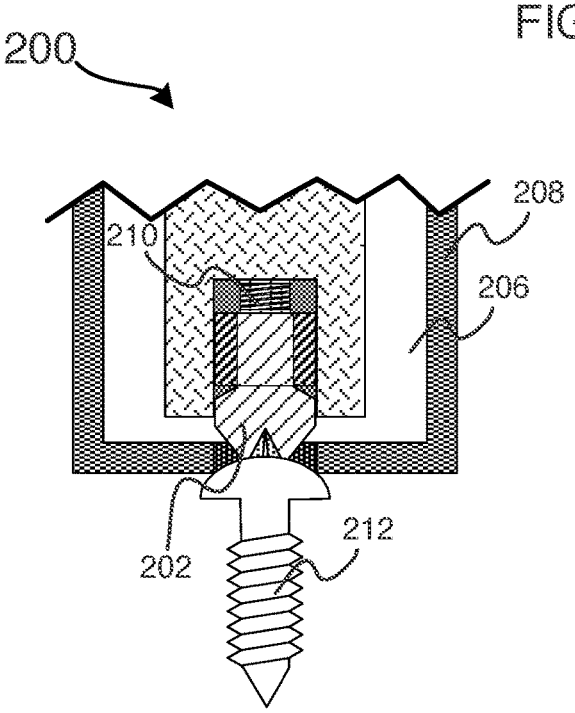
FIG. 2B depicts a view of the adjustable driver device configured to drive a screw with a domed screw head using the cruciform bit.
Figure 2C:
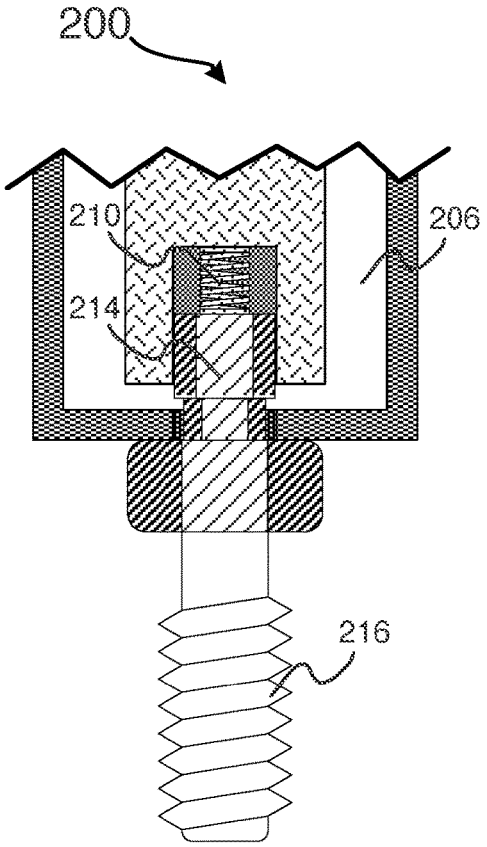
FIG. 2C depicts a view of an adjustable driver device configured to drive a bolt with a hex bit.

To illustrate the adjustability of a driver device according to the embodiments of the present disclosure, FIGS. 2A through 2C depict several views of an adjustable driver device 200 with several permutations of screw shapes and sizes and bit shapes and sizes. FIG. 2A, for example, illustrates a cruciform bit 202 mating with a screw 204 with a flat screw head. Because the screw head on screw 204 is flat, the screw head does not enter into vacuum chamber 206 past the sealing lip of device housing 208. Thus, spring 210 pushes cruciform bit 202 out to mate with screw 204 past the sealing lip.

FIG. 2B, for example, illustrates the same cruciform bit 202 mating with a screw 212 with a domed screw head. The domed head of screw 212 causes the portion of the screw head with which cruciform bit 202 to partially enter the vacuum chamber 206 past the sealing lip. However, due to the adjustability of driver device 200, screw 212 is able to push cruciform bit 202 back into the bit socket, causing spring 210 to compress further. When a vacuum (or partial vacuum) is created within vacuum chamber 206, screw 212 will be held in place by suction and cruciform bit 202 will be held in place by spring 210, encouraging screw 212 and cruciform bit 202 to maintain a proper interface.

FIG. 2C, on the other hand, illustrates a view of driver device 200 in which a hex bit 214 is mating with a larger screw 216 with a large bolt head. Because the bolt head of screw 216 is flat like the head of screw 204, the bolt head does not partially enter vacuum chamber 206. Rather, because of the large size of the bolt head of screw 216 and because of the nature of hex bits and sockets, hex bit 214 is extending further into screw 216 to make a proper interface than cruciform bit 202 was required to (or able to) extend into either screw 204 or screw 212. For this reason, hex bit 214 is extending further out of the bit socket than cruciform bit 202 in FIGS. 2A and 2B. As a result, spring 210 is extending further, pushing hex bit 214 into screw 216. Thus, even though the optimal position of hex bit 214 in FIG. 2C is further extended than the optimal position of cruciform bit 202 in FIGS. 2A and 2B, the adjustable nature of driver device 200 causes hex bit 214 to maintain a proper interface with screw 216.

As has been previously discussed, the adjustability of the driver devices of the present disclosure may be beneficial not only in use cases in which a driver device is operated manually by a user, but also in use cases in which a driver device is operated automatically (for example, by a robotic arm on an assembly line). For this reason, some embodiments of the present disclosure may be operated automatically by a computer system including a processor to perform a method of operating a driver device.

Figure 3:
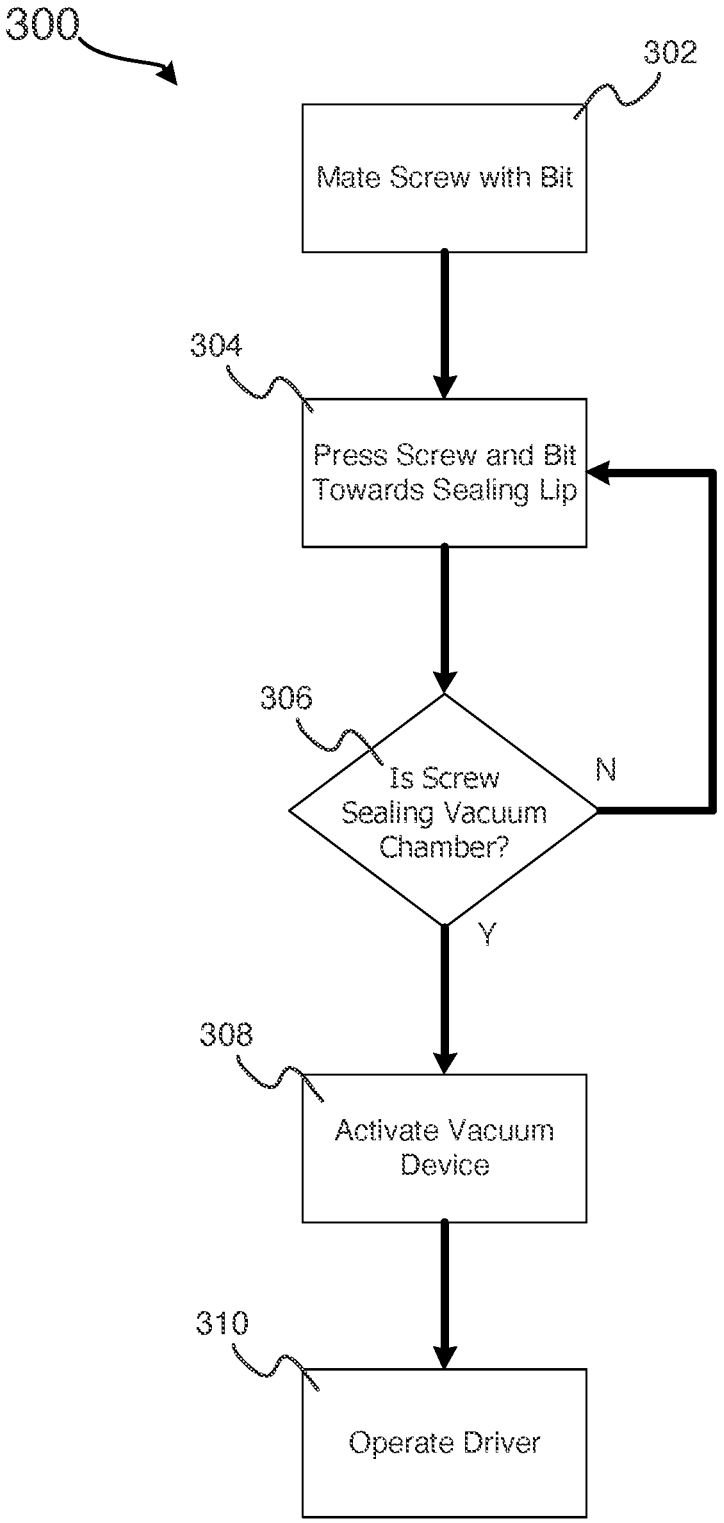
FIG. 3 depicts a method of using an adjustable driver device in accordance with embodiments of the present disclosure.

FIG. 3 illustrates a method 300 of operating a driver device according to the embodiments of the present disclosure. Method 300 may be operated, for example, by a computer system with a processor and a memory, such as the computer system of FIG. 4. The computer system may be configured to automatically operate, for example, a driver device on a robotic arm or a driver device that is otherwise automatically controllable.

Method 300 begins in block 302, in which a screw is mated with a bit of a driver device. This may involve, for example, a robotic arm grasping a screw and pressing the screw head of the screw onto a screwdriver bit that has been inserted into a bit socket of the driver device. The driver device may have a spring in the bit socket that pushes the screwdriver bit towards the screw, encouraging a proper interface between the screw and bit.

In block 304, the system presses the screw towards a sealing lip of the driver device. As a result, the screw may push the screwdriver bit further into the bit socket, compressing the spring within the bit socket. The spring may continue to push the screwdriver bit towards the screw, maintaining a proper interface even though both the screw and bit have changed position. Once the screw is seated on the sealing lip of the housing, the system may stop moving the screw.

In block 306, the system may determine wither the screw is sealing the vacuum chamber. For example, in some embodiments the system may be equipped with optical cameras that inspect the fit of the screw on a sealing lip to determine if a gap exists between the screw and the lip. In some embodiments these optical cameras may also inspect the angle of the screw to detect whether the screw is not properly seated. If the system determines that the screw is not sealing the vacuum chamber, the system repeats block 304. In some embodiments, this may involve pulling the screw back to the original position and pressing the screw again. In other embodiments, repeating block 304 may simply involve attempting to press the screw further towards the sealing lip.

If, on the other hand, the system determines in block 306 that the screw is sealing the vacuum chamber, the system activates a vacuum device that is connected to the driver device in block 308. Activating the vacuum device may create a partial (or complete) vacuum within the housing of the driver device, creating a suction that holds the head of the screw firmly on the sealing lip of the device housing. At this point, the screw may be strongly held in place by the vacuum, preventing the screw angle from shifting during operation. Further, a spring in a bit socket of the driver device may continue to push the screwdriver bit into the head of the screw, continuing to encourage a proper interface between the two. For this reason, the driver device may now be prepared to drive the screw, and the system operates the driver device in block 310.

Figure 4:
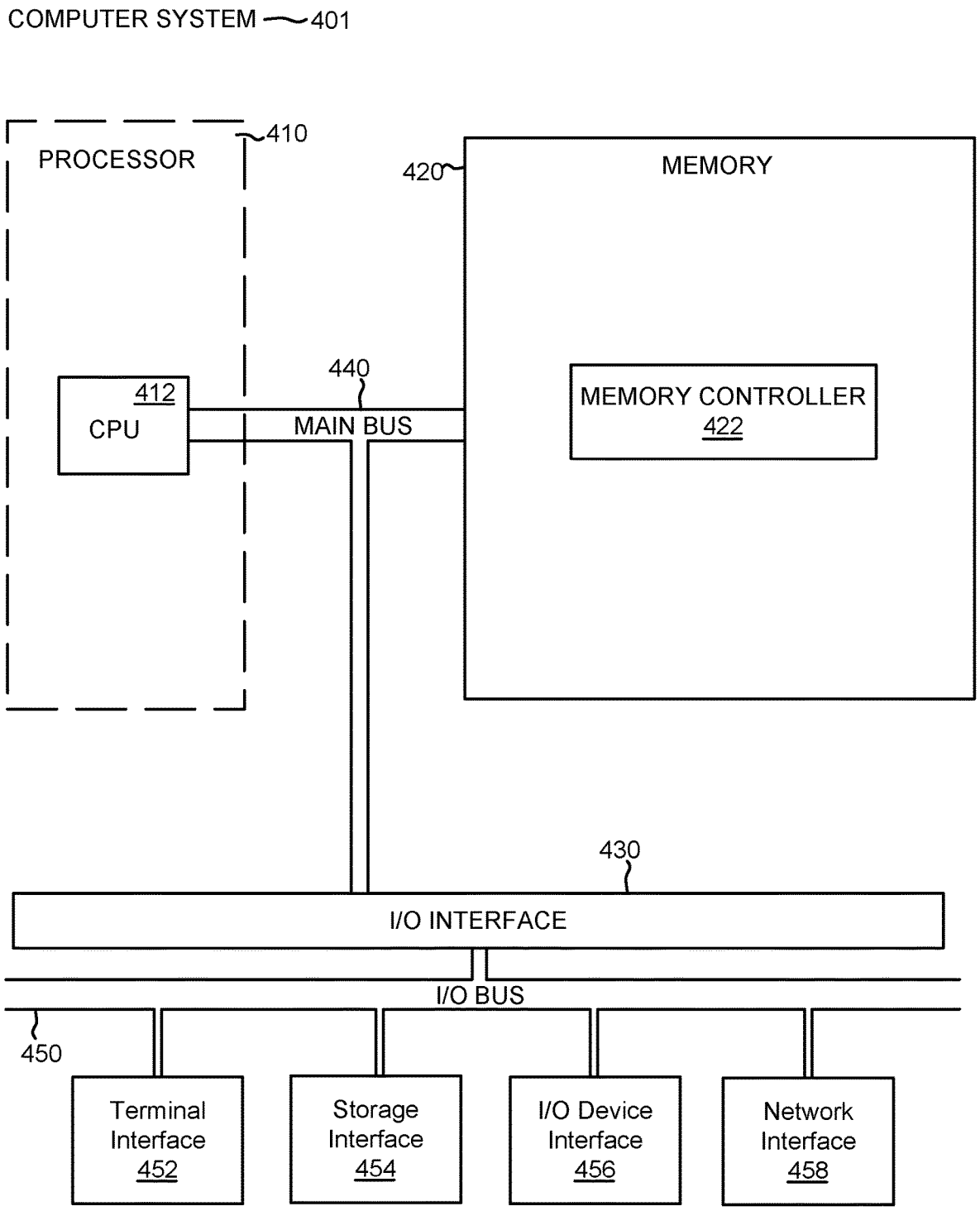
FIG. 4 depicts the representative major components of a computer system that may be used in accordance with embodiments.

FIG. 4 depicts the representative major components of an example Computer System 401 that may be used in accordance with embodiments of the present disclosure. The particular components depicted are presented for the purpose of example only and are not necessarily the only such variations. The Computer System 401 may include a Processor 410, Memory 420, an Input/Output Interface (also referred to herein as I/O or I/O Interface) 430, and a Main Bus 440. The Main Bus 440 may provide communication pathways for the other components of the Computer System 401. In some embodiments, the Main Bus 440 may connect to other components such as a specialized digital signal processor (not depicted).

The Processor 410 of the Computer System 401 may include one or more CPUs 412. The Processor 410 may additionally include one or more memory buffers or caches (not depicted) that provide temporary storage of instructions and data for the CPU 412. The CPU 412 may perform instructions on input provided from the caches or from the Memory 420 and output the result to caches or the Memory 420. The CPU 412 may include one or more circuits configured to perform one or methods consistent with embodiments of the present disclosure. In some embodiments, the Computer System 401 may contain multiple Processors 410 typical of a relatively large system. In other embodiments, however, the Computer System 401 may be a single processor with a singular CPU 412.

The Memory 420 of the Computer System 401 may include a Memory Controller 422 and one or more memory modules for temporarily or permanently storing data (not depicted). In some embodiments, the Memory 420 may include a random-access semiconductor memory, storage device, or storage medium (either volatile or non-volatile) for storing data and programs. The Memory Controller 422 may communicate with the Processor 410, facilitating storage and retrieval of information in the memory modules. The Memory Controller 422 may communicate with the I/O Interface 430, facilitating storage and retrieval of input or output in the memory modules. In some embodiments, the memory modules may be dual in-line memory modules.

The I/O Interface 430 may include an I/O Bus 450, a Terminal Interface 452, a Storage Interface 454, an I/O Device Interface 456, and a Network Interface 458. The I/O Interface 430 may connect the Main Bus 440 to the I/O Bus 450. The I/O Interface 430 may direct instructions and data from the Processor 410 and Memory 420 to the various interfaces of the I/O Bus 450. The I/O Interface 430 may also direct instructions and data from the various interfaces of the I/O Bus 450 to the Processor 410 and Memory 420. The various interfaces may include the Terminal Interface 452, the Storage Interface 454, the I/O Device Interface 456, and the Network Interface 458. In some embodiments, the various interfaces may include a subset of the aforementioned interfaces (e.g., an embedded computer system in an industrial application may not include the Terminal Interface 452 and the Storage Interface 454).

Logic modules throughout the Computer System 401—including but not limited to the Memory 420, the Processor 410, and the I/O Interface 430—may communicate failures and changes to one or more components to a hypervisor or operating system (not depicted). The hypervisor or the operating system may allocate the various resources available in the Computer System 401 and track the location of data in Memory 420 and of processes assigned to various CPUs 412. In embodiments that combine or rearrange elements, aspects of the logic modules' capabilities may be combined or redistributed. These variations would be apparent to one skilled in the art.

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be accomplished as one step, executed concurrently, substantially concurrently, in a partially or wholly temporally overlapping manner, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to explain the principles of the embodiments, the practical application or technical improvement over technologies found in the marketplace, or to enable others of ordinary skill in the art to understand the embodiments disclosed herein.

What is claimed is:

1. A driver device comprising:
- a housing;
- a hole located on the housing, wherein the hole comprises a sealing lip;
- a bit holder located within the housing;
- a bit socket located on the bit holder, wherein the bit socket is aligned with the hole, such that inserting a bit into the bit socket also inserts the bit into the hole;
- a spring located within the bit socket, wherein the spring causes an inserted bit to partially exit the hole in the absence of an external force pushing the bit against the spring;
- a vacuum component connected to the housing; and
- a vacuum chamber within the housing.

2. The driver device of claim 1, wherein the bit holder is magnetized.

3. The driver device of claim 1, wherein the spring pushes the bit into a position that the bit is capable of mating with a screw prior to the screw being seated on the sealing lip.

4. The driver device of claim 1, wherein the spring is magnetically attracted to the bit.

5. The driver device of claim 1, such that creating a partial vacuum in the vacuum chamber after a screw is seated on the sealing lip causes a pressure differential between the vacuum chamber and the environment surrounding the driver device and wherein the pressure differential is sufficient to cause the screw to resist shifting or tilting during operation of the driver device.

6. The driver device of claim 1, wherein the spring is configured to encourage the bit to properly interface with a screw pressed against the sealing lip.

7. The driver device of claim 1, further comprising:
- a robotic arm attached to the housing; and
- a processor configured to control the robotic arm and vacuum component.

8. A method of operating a driver device, the method comprising:
- mating a screw with a bit of the driver device;
- pressing the screw towards a sealing lip on a housing of the driver device;
- seating the screw on the sealing lip;
- creating a partial vacuum within the housing; and
- operating the driver device.

9. The method of claim 8, wherein pressing the screw towards the sealing lip causes the screw to push the bit further into a bit socket.

10. The method of claim 9, wherein the screw pushing the bit further into the bit socket causes the bit to depress a spring within the bit socket.

11. The method of claim 10, wherein the bit depressing the spring causes the spring to press against the bit, and wherein the spring pressing against the bit encourages the bit to properly interface with the screw.

12. The method of claim 8, wherein creating a partial vacuum within the housing creates a pressure differential between the vacuum chamber and the environment surrounding the driver device and wherein the pressure differential is sufficient to cause the screw to resist shifting or tilting during operation of the driver device.

13. The method of claim 8, wherein operating the driver device comprises moving a robotic arm attached to the housing.

14. A system comprising:

a processor; and a memory in communication with the processor, the memory containing program instructions that, when executed by the processor, are configured to cause the processor to perform a method of operating a driver device, the method comprising:

mating a screw with a bit of the driver device;

pressing the screw towards a sealing lip on a housing of the driver device;

seating the screw on the sealing lip;

creating a partial vacuum within the housing; and operating the driver device.

15. The system of claim 14, wherein pressing the screw towards the sealing lip causes the screw to push the bit further into a bit socket.

16. The system of claim 15, wherein the screw pushing the bit further into the bit socket causes the bit to depress a spring within the bit socket.

17. The system of claim 16, wherein the bit depressing the spring causes the spring to press against the bit, and wherein the spring pressing against the bit encourages the bit to properly interface with the screw.

18. The system of claim 14, wherein creating a partial vacuum within the housing creates a pressure differential between the vacuum chamber and the environment surrounding the driver device and wherein the pressure differential is sufficient to cause the screw to resist shifting or tilting during operation of the driver device.

19. The system of claim 14, wherein operating the driver device comprises moving a robotic arm attached to the housing.

* * * * *